US005611527A

United States Patent [19]

Wüthrich

[11] Patent Number: 5,611,527

[45] Date of Patent: Mar. 18, 1997

[54] DEVICE FOR DISPENSING A SHEETLIKE OBJECT FROM A STACK

[75] Inventor: Werner Wüthrich, Gümligen, Switzerland

[73] Assignee: Ascom Autelca AG, Gumligen, Switzerland

[21] Appl. No.: 416,352

[22] Filed: Apr. 4, 1995

[30] Foreign Application Priority Data

May 4, 1994 [CH] Switzerland ..... 1402/94

[51] Int. Cl.[6] ..... B65H 3/60

[52] U.S. Cl. ..... 271/133; 271/131; 271/137; 271/147; 271/160

[58] Field of Search ..... 271/42, 128, 131, 271/133, 134, 137, 138, 144, 147, 160, 161, 188; 221/268, 270, 232

[56] References Cited

U.S. PATENT DOCUMENTS

| | | | |
|---|---|---|---|
| 1,027,598 | 5/1912 | Dempewolf | 271/137 |
| 1,096,539 | 5/1914 | Jagenberg | 271/42 |
| 2,723,118 | 11/1955 | Malmros et al. | 271/133 |
| 3,549,866 | 12/1970 | McWade et al. | 271/131 |
| 3,570,845 | 3/1971 | Kellerman | 271/131 |
| 4,603,792 | 8/1986 | Molineux | 221/232 |
| 4,783,064 | 11/1988 | Hayashi . | |
| 5,074,432 | 12/1991 | MacNamara | 271/144 |

FOREIGN PATENT DOCUMENTS

| | | | |
|---|---|---|---|
| 406100183 | 4/1994 | Japan | 271/147 |
| 2132592 | 7/1984 | United Kingdom . | |
| 2144722 | 3/1985 | United Kingdom . | |

*Primary Examiner*—H. Grant Skaggs
*Attorney, Agent, or Firm*—Birch, Stewart, Kolash & Birch, LLP.

[57] ABSTRACT

A device for dispensing a sheetlike object, especially a card with magnetic strip, from a stack has a storage compartment for the stack and an object removal unit on a lower side of the storage compartment. The object removal unit has a conveying element movable back and forth under control perpendicular to the stack, i.e., in dispensing direction (x). According to the invention, the conveying element has a supporting surface concave in dispensing direction (x) and/or convex in a transverse direction (y) which is orthogonal to dispensing direction (x). With an element thus shaped, cards already used and bent in various ways can be reused for automatic card dispensing.

12 Claims, 3 Drawing Sheets

Fig.3a
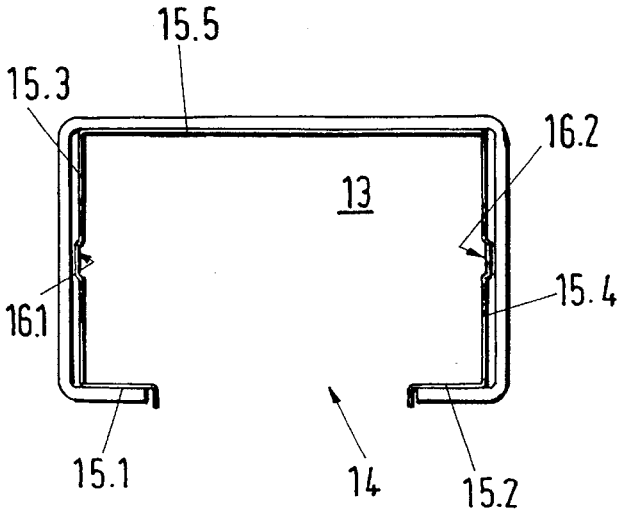
Fig.3b
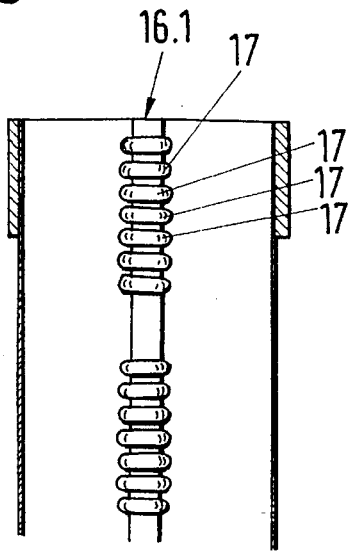
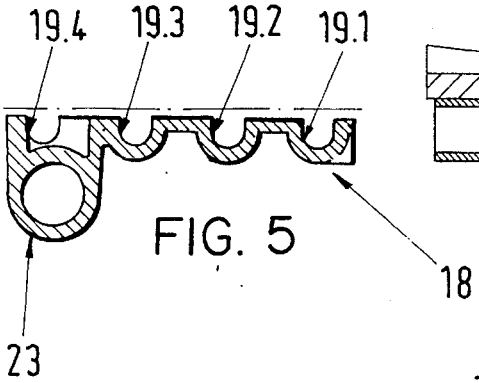
FIG. 5
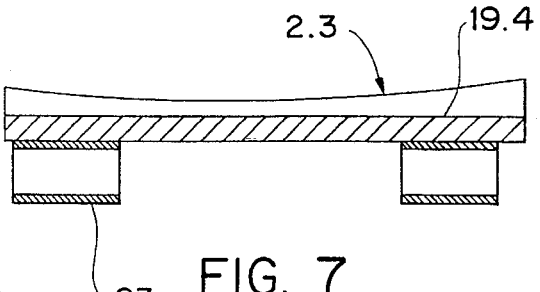
FIG. 7
Fig. 4
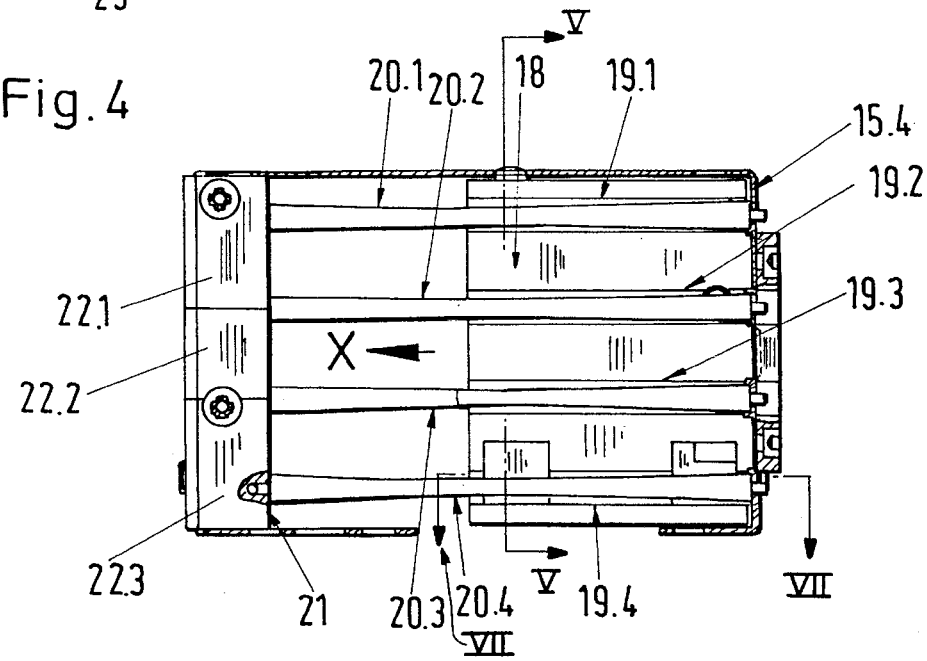

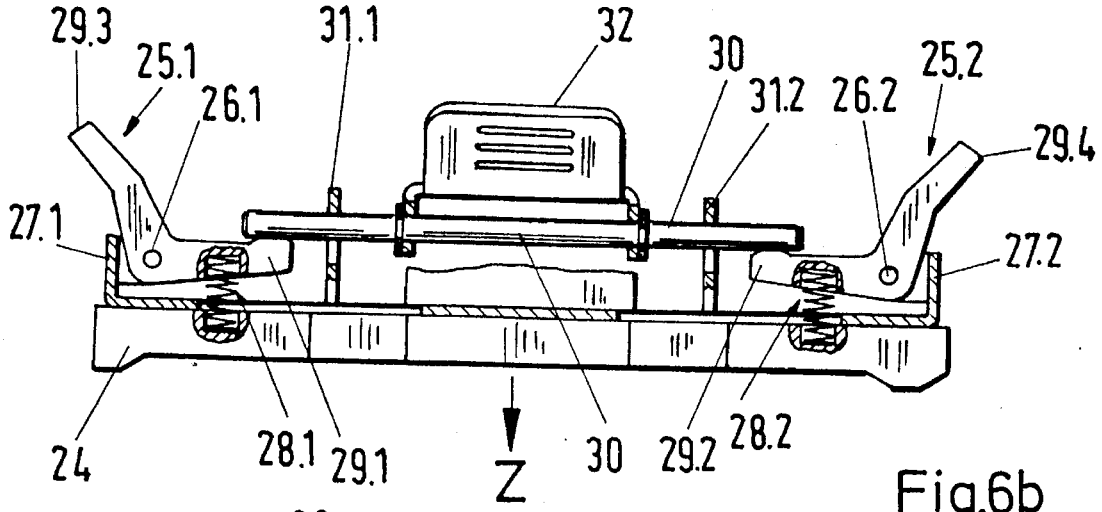
Fig.6b
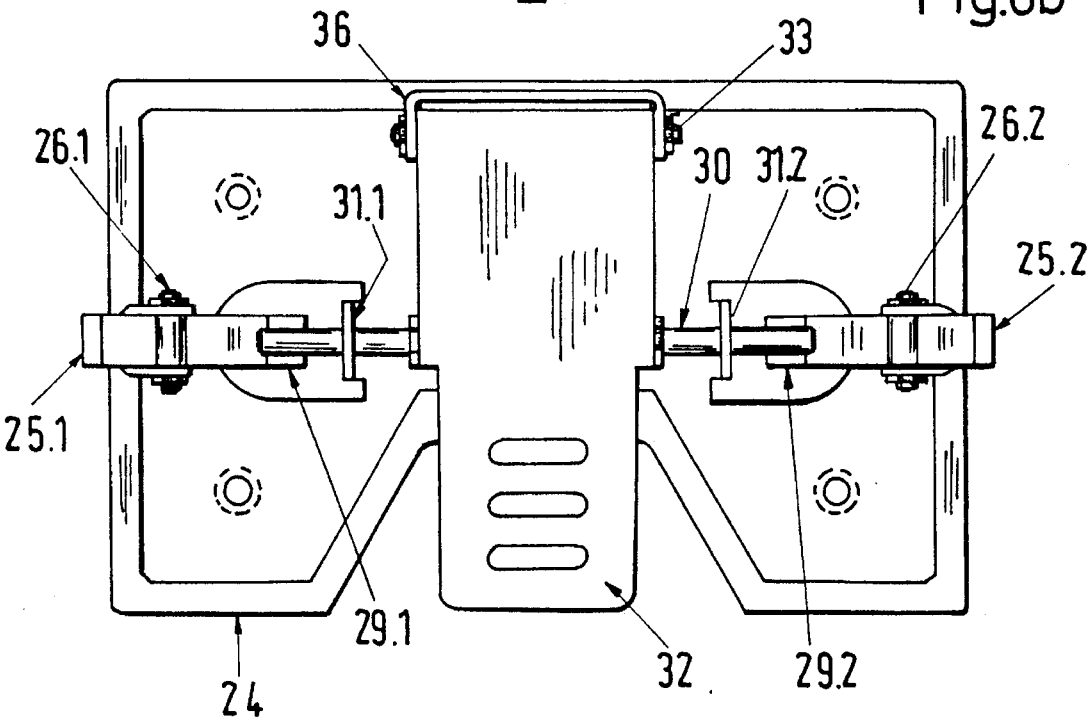
Fig.6c
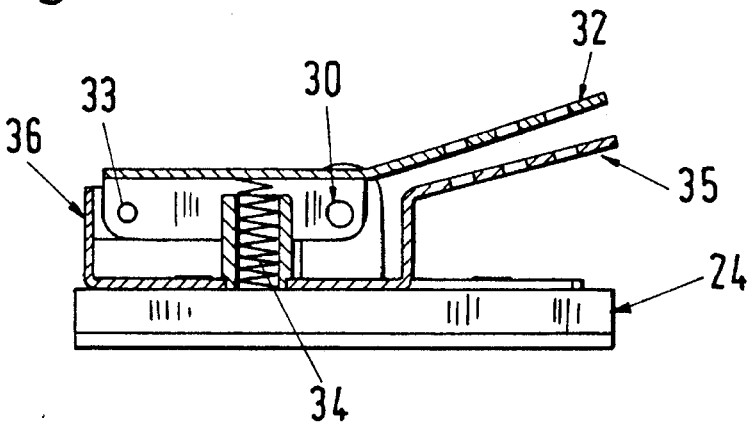

DEVICE FOR DISPENSING A SHEETLIKE OBJECT FROM A STACK

BACKGROUND OF THE INVENTION

1. Technical Area

The invention relates to a device for dispensing a sheetlike object from a stack, with a storage compartment for the stack and an object removal unit on a lower side of the storage compartment having a flat element movable under control perpendicular to the stack, that is, in the dispensing direction.

2. Prior Art

Automatic ticket devices are known in which unprinted tickets are stored in a stack and automatically removed, printed, and dispensed when a key is pressed.

Automatic gate systems operating with tickets having magnetic strips are used with increasing frequency in subway systems. Since the magnetic strips can be repeatedly overwritten, it would be expedient to use the tickets several times rather than just once.

The problem encountered in reuse of used tickets is that the tickets are easily deformed in use, since they understandably must be made as thin and as cheaply as possible.

It has now been found that it is not possible to stock the prior-art automatic devices suitable for dispensing new tickets directly with used and recycled tickets. Old tickets, which are for the most part bent along their longitudinal or transverse axis, cannot be gripped properly for dispensing by the dispensing mechanism, and in addition may jam this mechanism.

SUMMARY OF THE INVENTION

The object of the invention is now to indicate a device of the initially-mentioned type, which is suitable for dispensing both new and old cards.

According to the invention, the achievement of the object consists in the fact that the element has a concave supporting surface and/or a convex supporting surface perpendicular to the direction of dispensing for the object to be dispensed.

This measure makes certain that the middle of the rear side and the middle of the front side of the object (e.g., a card) assume a precisely defined position relative to the dispensing direction at the beginning of the conveying process, even if the card is slightly curved around its longitudinal or transverse axis. The middle of the rear side is the point of engagement of the conveying mechanism. Knowledge of the position of the middle of the front side of the card makes possible trouble-free conveyance through a dispensing slot in the device. It is advantageous for convex and concave bending to be executed simultaneously.

A raised impact edge corresponding in thickness to that of the sheetlike object is preferably provided on the supporting surface of the element, on a back end relative to the direction of dispensing. It is to be noted that the card can be pulled away both on the basis of the impact edge referred to and by use of the more or less flat contact between the card to be dispensed and the conveying element under the stack. The relatively large supporting surface reduces the load and accordingly wear of the edge of the card (the rear edge relative to the direction of dispensing).

The degree of convexity of the supporting surface of the element from front to rear (relative to the direction of dispensing) is preferably small. The rearmost area of the supporting surface, in particular, is completely flat. A clear-cut horizontal orientation of the back end of the card, and thus stabilization of the entire stack, can be achieved in this way.

The convexity of the supporting surface transversely to the direction of dispensing is achieved preferably by three lamellar flat areas tilted toward each other. The adjoining, individually flat areas form an angle, for example, of 0.5 to 5°. The angle may be varied in the direction of dispensing, i.e., the angle set in the forward area may be different from that set in the rearward area of the supporting surface.

To permit the shortest possible method of construction in the direction of dispensing, the supporting surface of the element (or the shuttling element as a whole) may be shorter in the direction of dispensing than the object to be dispensed. It is possible in principle for the lowest object to project, e.g., by 20 to 40% of its dimension, below the stack, so that it can then be engaged by a conveying mechanism with rollers and transported further under control. The length of the supporting surface should in any event be greater than one-half the length of the object in the direction of dispensing, so that the center of gravity of the stack will always be above the supporting surface.

The element moves preferably in a rack having several support rods arranged parallel to the direction of dispensing to support the stack when an object is dispensed. The rods narrow initially from the rear to the center and then become wider again from the center forward, conforming to the concave surface in the direction of dispensing. The element grips through the rods from below to form the supporting surface according to the invention or parts of this surface.

The storage compartment for the stack is enclosed by a wall which, in alignment with the supporting surface of the shuttling element, has a dispensing slot whose smallest width is in the center and which widens symmetrically outward in conformity with the convexity of the supporting surface. Since the center of the object (the front edge of the center relative to the direction of dispensing) is always placed in the same position by the supporting surface according to the invention independently of the curvature in any circumstances, the card can be reliably dispensed. The greater width in the vicinity of the exterior of the slot creates the passage required for cards bent upward or downward crosswise to the direction of dispensing.

The storage compartment is formed, e.g., by a shaft open on the longitudinal side. The shaft has, e.g., a C-shaped profile. The open side permits introduction or removal of a stack weighting or securing device.

According to an especially preferable embodiment, a removable stack holder is provided which can move downward in the shaft as the height of the stack decreases but cannot spontaneously move upward. The stack holder permits conveyance of devices filled with cards. This is necessary because the devices according to the invention are retrievably introduced into an automatic card dispensing machine and are moved for the purpose of filling to a central position from which they are conveyed in the filled state to the automatic machines and are introduced into the latter.

The shaft has on its interior a ribbed structure for the stack holder which can be engaged by a locking mechanism of the stack holder.

The locking mechanism has two levers forced outward into the ribbed structure by spring tension, these levers being designed and arranged so that the stack holder can spontaneously move only downward, not upward, in the shaft. The stack holder may be removed manually for filling the shaft.

Other advantageous embodiments and combinations of features follow from the detailed description and the patent claims in their entirety.

BRIEF DESCRIPTION OF THE DRAWINGS

The invention is to be explained in more detail below based on the embodiments and in connection with the drawings. There are shown in:

FIG. 3*a,b* shows a diagrammatic representation of a shaft for storing a stack;

FIG. 4 shows an especially preferred embodiment of a dispensing device with supporting racks;

FIG. 5 shows a sectional view of a conveying element for use in combination with a supporting rack according to the section lines IV—IV of FIG. 4;

FIG. 6*a,b,c* shows different views of a preferred stack holder.

FIG. 7 shows a sectional review of a conveying element for use in combination with a supporting rack according to the section lines VII—VII of FIG. 4.

In the figures, identical parts are always provided with the same reference symbols.

DESCRIPTION OF THE PREFERRED EMBODIMENT

Figure 1:
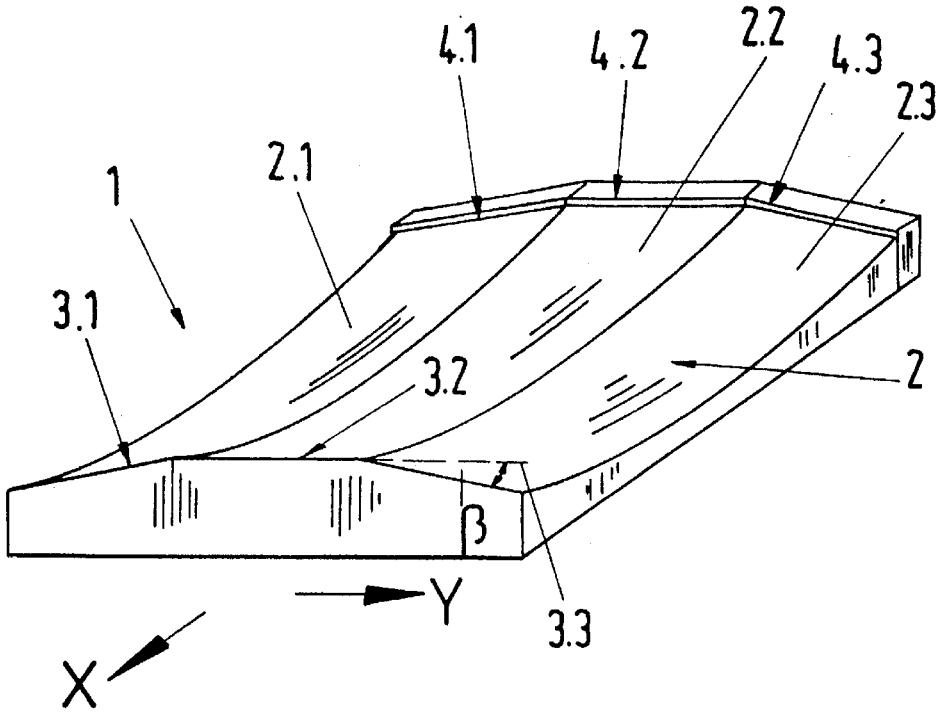
FIG. 1 shows a diagrammatic representation in perspective of a conveying element according to the invention.

FIG. 1 illustrates the principle of the invention. A conveying element 1, which is to extract the lowest card of a stack (resting on the card), has a supporting surface 2 for the card which is concave in dispensing direction x and convex in transverse direction y perpendicular to it. Supporting surface 2 in the present case has three lamellar partial surfaces 2.1, 2.2, 2.3. As front edges 3.1, 3.2, 3.2. illustrate, three partial surfaces 2.1, 2.2, 2.3 are flat by section in direction y. Angle β between the flat sections falls within the range of 0.5 to 5°, preferably at around 2°. The radius of curvature in the longitudinal direction is of the order of magnitude of 0.5 to 2 m, preferably at around 1 m.

Stops 4.1, 4.2, 4.3 are formed at the back ends of partial surfaces 2.1, 2.2., 2.3, which are of more or less the same width. What are involved are steps whose height corresponds approximately to the thickness of a card.

The effect of arched supporting surface 2 according to the invention is as follows, depending on the curvature of the card resting on it:

1. If the longitudinal edges of the supported card are curved upward around an axis parallel to direction x, the card rests mostly at edge 3.2 and stop 4.2 and otherwise curves laterally upward.

2. If the longitudinal edges of the supported card are curved downward around an axis parallel to direction x, it additionally rests against edges 3.1 and 3.3 and against stops 4.1 and 4.3. Although there is mostly no contact between card and supporting surface 2 in the direction of the x axis, contact at the important support points (3.2 and 4.2) is ensured.

3. If the card is curved downward from its center around an axis parallel to direction y, it rests more or less on entire partial surface 2.2. Even if there is no contact in partial surfaces 2.1, 2.3, at least the positioning at edge 3.2 and at stop 4.2 is ensured.

4. If the card is curved upward from its center around an axis parallel to direction y, positioning at edge 3.2 and at stop 4.2 is ensured even though the flat support is relatively small.

It is important to note that in all situations, the lead card in dispensing direction x assumes a clearly defined position during conveyance independently of the curvature of the card, so that accurate insertion into a dispensing slot is assured. The fact that the card rests against central stop 4.2, again independently of card curvature, ensures directionally stable conveyance of the card, since the application of force takes place centrally rather than eccentrically. In most cases, card conveyance is promoted by support over a large area.

Figure 2:
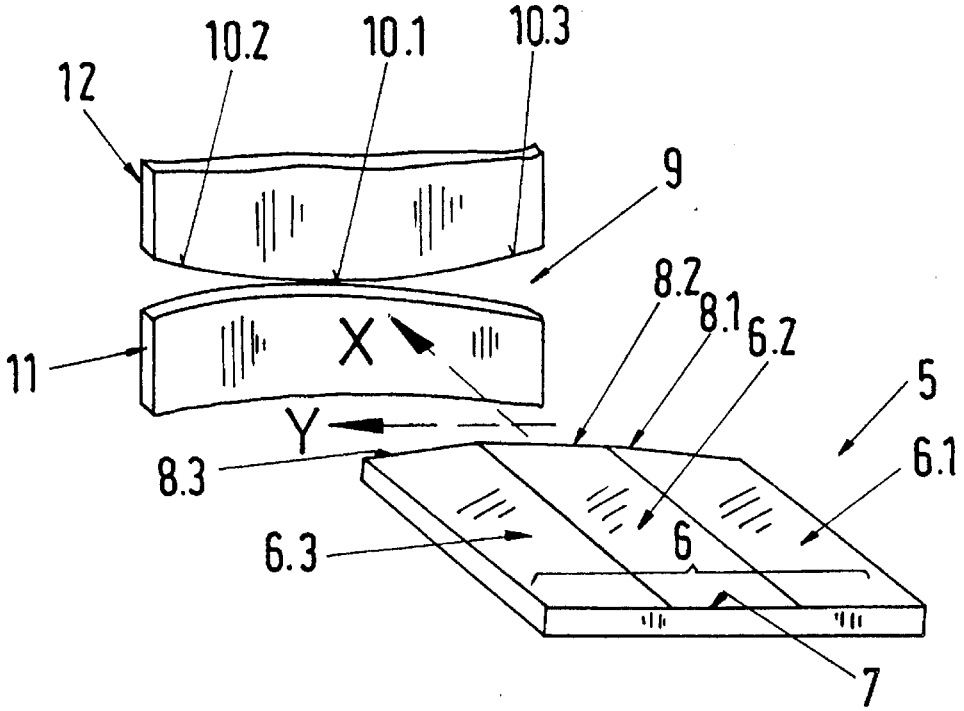
FIG. 2 shows a diagrammatic representation in perspective of a dispensing device.

FIG. 2 illustrates a conveying element 5 by which a card to be dispensed can be moved through a slot 9. A supporting surface 6 concave in direction x and convex in direction y is provided here as well. In contrast to FIG. 1, curved partial surfaces 6.1, 6.2, 6.3, positioned at an angle to each other, end in a common straight rear edge 7. As a result, supporting surface 6 has in the area of rear edge 7 a horizontal and more or less completely flat supporting surface for the card stack. This serves the purpose of stabilizing the stack.

Corresponding to FIG. 1, front edges 8.1, 8.2, 8.3 are positioned at an angle >0 to one another. They form a curve corresponding to the curvature of a lower plate 11 adjacent to slot 9. Conveying element 5 is guided by suitable means so that it can be moved in direction x to slot 9 and back again.

Slot 9 is narrower at its center 10.1 than at its outer ends 10.2 and 10.3. Plate 12 shaped as a mirror image of plate 11 can accordingly effect a clear-cut discrimination of the cards to be retained in the stack from those to be dispensed. The greater slot width at ends 10.2 and 10.3 of slot 9 leave room for any sides of cards whose outer edges may project upward or downward.

An especially preferred embodiment of the invention will now be explained based on FIG. 3 to 6.

FIG. 3*a* shows a cross section through a shaftlike storage compartment 13 for a stack of cards. The inner cross section of storage compartment 13 corresponds more or less to the length and width of an individual card.

Storage compartment 13 is bounded by two narrow front walls 15.1, 15.2, two side walls 15.3, 15.4, and a rear wall 15.5. Front walls 15.1, 15.2 delimit laterally an opening 14 extending over the entire height of the shaft. As is clearly to be seen from FIG. 3*a*, the shaft has a rectangular C-shaped profile in cross section.

A regular ribbed structure 16.1, 16.2 extending over the entire height of storage compartment 13 is molded into the center of side walls 15.3, 15.4. As FIG. 3*b* shows, striplike ribbed structure 16.1 has a plurality of similar spaced recesses 17.

At the very bottom of the shaft is a dispensing unit according to the invention. When required it conveys the bottom card in the stack through a (horizontal) slot in side wall 15.3 to the exterior, where the card is gripped by a conveying mechanism with rollers so as to be fully extracted from the shaft. Hence electromagnetic inscription of a magnetic strip integrated into the card takes place outside the shaft.

FIG. 4 shows a top view of a dispensing device according to the invention, one which, as has already been mentioned, is built into the lowest part of the shaft. A table-like conveying element 18 whose length is somewhat greater than one-half the cross-sectional length of the shaft can be moved back and forth in dispensing direction x by drive means not shown in detail. (An example of drive means is an electric motor arranged below conveying element 18. By way of reduction gear this motor drives a cam which rotates through 360°, driving conveying element 18 once forward and once back.)

According to an especially preferred embodiment, conveying element 18 runs between a rack formed by four rods 20.1, . . . , 20.4. For rods 20.1, . . . , 20.4, the conveying element has on its surface four groove-shaped recesses 19.1, . . . , 19.4 extending over the entire length of the element. Viewed in cross section, they are seen to be just deep enough so that rods 20.1, . . . , 20.4 do not project from them. The actual partial supporting surfaces are situated between recesses 19.1, . . . , 19.4. They are part of the total surface, which is curved according to FIG. 1 or 2.

A narrow table 21 forming a supporting surface from three partial surfaces 22.1, 22.2, 22.3 is mounted immediately in front of the dispensing slot (not shown). The supporting surface is curved perpendicular to dispensing direction x in the same way as is conveying element 18.

Rods 20.1, . . . , 20.4 extend from wall 15.4 up to table 21. They support the stack when the lowest card is dispensed. To correspond to the concave curvature of the supporting surface of conveying element 18, their cross section narrows visibly from wall 15.4 toward the middle of the rod and then widens again. Hence rods 20.1, . . . , 20.4 form double cones rather than being cylindrical.

On the lower side, the conveying element 18 has one or two guide bushings 23 for a guide rod (not shown). The guide rod is, of course, mounted parallel to rods 20.1, . . . , 20.4. FIG. 5 shows a conveying element in cross-section along the transverse direction (y) while FIG. 7 shows such conveying element in cross-section along the dispensing direction (x).

A so-called stack holder is provided so that it will be possible for a shaft filled with a stack of cards to be conveyed without the danger that the cards could fall out. The holder is represented essentially by a weighting plate with a locking mechanism which engages ribbed structures 16.1, 16.2 so that while the stack can move downward, it cannot now move upward.

FIG. 6*a–c* show an embodiment of such a stack holder. Holding devices 27.1, 27.2, on each of which an articulated lever 25.1, 25.2 is mounted rotatably around an axis 26.1, 26.2, are fastened in the center of the short side on a weighting plate 24 rectangular (or similar in shape to a rectangle) in outline which fits into storage compartment 13. An arm 29.1, 29.2 of articulated lever 25.1, 25.2 projects inward (i.e., toward the center of the plate) from axis 26.1, 26.2 more or less horizontally to the weighting plate. Between arm 29.1, 29.2 and plate 24, there is a spring 28.1, 28.2 forcing arm 29.1, 29.2 upward and consequently the other end (arm 29.3, 29.4) of articulated lever 25.1, 25.2 outward into the ribbed structure 16.6, 16.2 (not shown in FIG. 6*a–c*).

Bracing 36 is provided in the center of the longitudinal side of weighting plate 24; a holding plate 32 is mounted rotatably around an axis 33 parallel to weighting plate 24 on bracing 36. Holding plate 32 extends over the entire width of weighting plate 24 to the opposite longitudinal side. A rod 30 is mounted in the center of holding plate 32. It is retained parallel to weighting plate 24. This rod extends to arms 29.1, 29.2 of articulated levers 25.1, 25.2. Arms 29.1, 29.2 in question are forced from below by spring 28.1 or 28.2 against rod 30. In addition, rod 30 is guided through two guides 31.1, 31.2 mounted respectively between the end of arm 29.1 or 29.2 and holding plate 32. Guides 31.1, 31.2 have two longitudinal apertures which define both the uppermost and the lowest (horizontal) position of rod 30.

As can be seen from FIG. 6*c*, holding plate 32 is forced upward by a spring 34. Consequently, rod 30 is normally positioned at the upper stop of guides 31.1, 31.2 (uppermost position).

At a certain distance from upper holding plate 32, there is a rigidly mounted second holding plate 35 (see FIG. 6*c*). The locking mechanism can be released by application of holding plates 32 and 35 to each other, as is to be explained below in detail.

Weighting plate 24 is positioned at the very top of the stack in storage compartment 13 (cf. FIG. 3*a*). Arms 29.3, 29.4 of articulated levers 25.1, 25.2 project laterally outward into recesses 17 in ribbed structures 16.1, 16.2. Since the outward projecting arms of articulated levers 25.1, 25.2 extend upward, e.g., approximately at an angle of 60° (relative to weighting plate 24), the device can move downward in conformity with the diminishing height of the stack in direction z, the ends of arms 29.3, 29.4 snapping into the immediately lower stage of the ribbed structure. In the process of movement from one recess into the next, articulated levers 25.1, 25.2 rotate slightly inward against the force of springs 28.1, 28,2 and then outward again when they snap into the next recess.

On the other hand, the device can no longer be displaced upward, i.e., in the direction opposite direction z, since articulated levers 25.1, 25.2 then block its path.

Two holding plates 32 and 35 are grasped by the fingers and forced against each other for the purpose of filling the shaft. Arms 29.1, 29.2 are forced downward by rod 30 and the outer ends of articulated levers 25.1, 25.2 are thereby extracted from the ribbed structure. Consequently, the device can be extracted from the shaft at the top. (Access is made possible through opening 14 according to FIG. 3*a*).

The invention is not, of course, restricted to the embodiment described. Specifically, the stack can be secured by another method, i.e., with another "one-way mechanism."

If necessary, it is also possible to dispense with the surface structure involving rods 20.1, . . . , 20.4. The embodiments shown afford the great advantage that they are very compact in design and accordingly can be fully integrated into the lower section of the shaft. If more space is available, the stack can be supported by other means during dispensing of a card (e.g., by a longer shuttle table).

In summary, it may be stated that the invention makes it possible to recycle used tickets and the like in automatic card dispensing machines at low additional technological cost.

I claim:

1. A device for dispensing a sheetlike object from a stack comprising a storage compartment (13) for the stack and an object removal unit on a lower side of the storage compartment (13) including a conveying element (1; 18) movable perpendicularly to the stack in a dispensing direction (x), wherein said conveying element (1; 18) has a supporting surface (2; 2.1, 2.2, 2.3) shaped in a manner of at least one of the group consisting of concave in the dispensing direction (x) and convex in a transverse direction (y) which is orthogonal to the dispensing direction (x).

2. The device according to claim 1, wherein the supporting surface (2) is bounded at its back end relative to the dispensing direction (x) by an elevated stop edge (4.1, 4.2, 4.3) having a height corresponding to a height thickness of the object.

3. The device according to claim 1, wherein said conveying element further has a flat portion, said flat portion being disposed adjacent to the supporting surface (6) at a rearmost portion thereof relative to the dispensing direction (x).

4. The device according to claim 1, wherein the supporting surface has an inner and a pair of outer flat adjoining portions (2.1, 2.2, 2.3) tilted slightly toward each other transverse to the dispensing direction (x).

5. The device according to claim 4, wherein each of the outer adjoining portions form an angle (β) of the order of magnitude in a range of 0.5 to 5° to the inner portion.

6. The device according to claim 1, wherein the supporting surface is shorter in length than the object to be dispensed and than the storage compartment (13) in the dispensing direction (x).

7. The device according to claim 1, wherein said object removal unit further includes a rack having a plurality of supporting rods (20.1, . . . , 20.4) which supportingly interfaces with the stack when an object is dispensed.

8. The device according to claim 7, wherein the storage compartment (13) includes a wall (11, 12) with a dispensing slot (9) having a first edge and a second edge, said first edge being opposite said second edge, said dispensing slot having a variable width, a smallest width being at a center thereof, the width increasing symmetrically outward (10.2, 10.3) from the center such that said first and second edges are in substantial conformity with convexity (β) of the supporting surface (6.1, 6.2, 6.3).

9. The device according to claim 1, further comprising a removable stack holder (24) having a holding mechanism, the stock holder being adapted to be moveable downward in conformity with the diminishing stack height in the storage compartment (13) and moveable upward upon disengagement of the holding mechanism.

10. The device according to claim 9, wherein the storage compartment (13) has a shaft (15.1, . . . , 15.5) with an interior ribbed structure (16.1, 16.2) for engagement of the holding mechanism.

11. The device according to claim 10, wherein the holding mechanism includes a locking mechanism with two levers (25.1, 25.2) forced outward into the ribbed structure (16.1, 16.2) by a plurality of springs (28.1, 28.2).

12. The device according to claim 10, wherein the storage compartment (13) includes one side wall (15.1, 15.2) having a vertically extending aperture therethrough from a top to a bottom thereof.

* * * * *